US006370926B1

(12) United States Patent
Han et al.

(10) Patent No.: US 6,370,926 B1
(45) Date of Patent: Apr. 16, 2002

(54) WASHING MACHINE

(75) Inventors: Yong-Woon Han, Kunpo; Hyung-Kyoon Kim, Suwon; Chul Kim, Anyang, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/903,517

(22) Filed: Jul. 13, 2001

(30) Foreign Application Priority Data

Apr. 23, 2001 (KR) ..... 01-21793

(51) Int. Cl.[7] ..... D06F 39/00; D06F 23/04

(52) U.S. Cl. ..... 68/23 R; 68/48; 68/96; 68/156

(58) Field of Search ..... 68/21, 23 R, 48, 68/50, 96, 156

(56) References Cited

U.S. PATENT DOCUMENTS 3,771,335 A * 11/1973 Hall ..... 68/96 X

FOREIGN PATENT DOCUMENTS

JP hei11-4990 12/1999

* cited by examiner

*Primary Examiner*—Philip R. Coe
(74) *Attorney, Agent, or Firm*—Robert E. Bushnell, Esq.

(57) ABSTRACT

A washing machine, provided with a twistable washing tub inside a perforated spin-drying tub for improving its cleaning effect, is disclosed. The twistable washing tub is repeatedly twisted and untwisted at its sidewall during a washing process, thus repeatedly compressing and releasing the laundry and improving the laundry cleaning effect. The washing machine includes an outer tub containing water therein, and a drive unit installed at a position outside the outer tub and generating rotating force. A washing tub is rotatably set within the outer tub, and is connected to the drive unit at its lower portion. This washing tub is twistable and deformable at its sidewall to compress the laundry contained therein during a rotating action of the washing tub.

11 Claims, 11 Drawing Sheets

WASHING MACHINE

CLAIM OF PRIORITY

This application makes reference to, incorporates the same herein, and claims all benefits accruing under 35 U.S.C. §110 from an application for WASHING MACHINE earlier filed in the Korean Industrial Property Office on Apr. 23, 2001 and there duly assigned Serial No. 21793/2001 by that Office.

BACKGROUND OF THE INVENTION

1. Field of the Invention

The present invention relates to washing machines and, more particularly, to a washing machine provided with a twistable washing tub within a perforated spin-drying tub for improving its cleaning effect.

2. Description of the Prior Art

As shown in FIG. 1, a conventional washing machine comprises an outer tub 1 containing water therein, a perforated spin-drying tub 2 concentrically and rotatably set within the outer tub 1, and a pulsator 3 rotatably set within the spin-drying tub 2 and agitating laundry and washing water within the tub 2. The washing machine also has a drive unit for rotating the spin-drying tub 2 and the pulsator 3. This drive unit comprises a reversible drive motor 4 and a power transmission device 5. The motor 4 is installed on the outer surface of the bottom wall of the outer tub 1, while the power transmission device 5 transmits the rotating force of the motor 4 to the spin-drying tub 2 and the pulsator 3.

During an operation of the washing machine, the pulsator 3 within the spin-drying tub 2 is repeatedly rotated in opposite directions by the rotating force of the drive motor 4, thus agitating the washing water and laundry within the spin-drying tub 2 and cleaning the laundry.

The conventional washing machine is designed in that the laundry cleaning effect is only accomplished by the frictional action of the laundry within the swirling washing water. Therefore, the washing machine is problematic in that it is almost impossible for the washing machine to accomplish desired cleaning effect while washing exceedingly dirty laundry since the machine may fail to wash off the dirt from the laundry.

SUMMARY OF THE INVENTION

Accordingly, the present invention has been made keeping in mind the above problems occurring in the prior art, and an object of the present invention is to provide a washing machine, which is provided with a twistable washing tub designed to be repeatedly twisted and untwisted during a washing process, thus repeatedly compressing and releasing the laundry and improving the laundry cleaning effect.

In order to accomplish the above object, the present invention provides a washing machine, comprising: an outer tub containing water therein; a drive unit installed at a position outside the outer tub to generate rotating force; and a washing tub rotatably set within the outer tub and connected to the drive unit at its lower portion, the washing tub being twistable and deformable at its sidewall to compress the laundry contained therein when the washing tub is rotated by the rotating force of the drive unit.

In the washing machine, the washing tub comprises: a lower rotary disc connected to a washing tub shaft rotated in conjunction with the drive unit; a plurality of twistable bars upwardly extending from the edge of the lower rotary disc, each of the twistable bars being made of flexible and elastic material; and an upper ring holding top ends of the twistable bars.

The washing machine further comprises: a spin-drying tub installed outside the washing tub to surround the washing tub, the spin-drying tub being selectively rotated by the drive unit to spin-dry the laundry, with the upper ring being mounted to the upper end of the spin-drying tub.

The washing tub shaft comprises first and second shaft parts coupled together such that the washing tub shaft is extendible in an axial direction, thus allowing the lower rotary disc to be vertically movable in opposite directions.

The washing machine further comprises an elastic member for normally biasing the lower rotary disc downward in a vertical direction. In addition, the first and second shaft parts of the washing tub shaft are hollow shaft parts, and receive the elastic member therein.

In another embodiment, the second shaft part is a hollow shaft part fitted over the first shaft part, and has a flange at its upper end, with the elastic member being connected to both the flange and the lower rotary disc at its opposite end.

In another embodiment, the washing machine further comprises: a spin-drying tub installed outside the washing tub to surround the washing tub, the spin-drying tub being selectively rotated by the drive unit to spin-dry the laundry; and a guide means for guiding a vertical movement of the upper ring relative to the spin-drying tub, the guide means being provided on both the inner surface of the spin-drying tub and the upper ring.

The guide means comprises a plurality of guide rails vertically formed on the inner surface of the spin-drying tub, and a plurality of guide grooves formed on the upper ring at positions corresponding to the guide rails, with an elastic member connected to the upper ring and the upper end of the spin-drying tub and normally biasing the upper ring upward in a vertical direction.

In the washing machine, a cylindrical bellows member covers a gap between the upper end of the spin-drying tub and the upper ring.

In addition, one or more pulsating blades are formed on the top surface of the lower rotary disc to generate active swirling currents in the water during a rotating action of the rotary disc.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
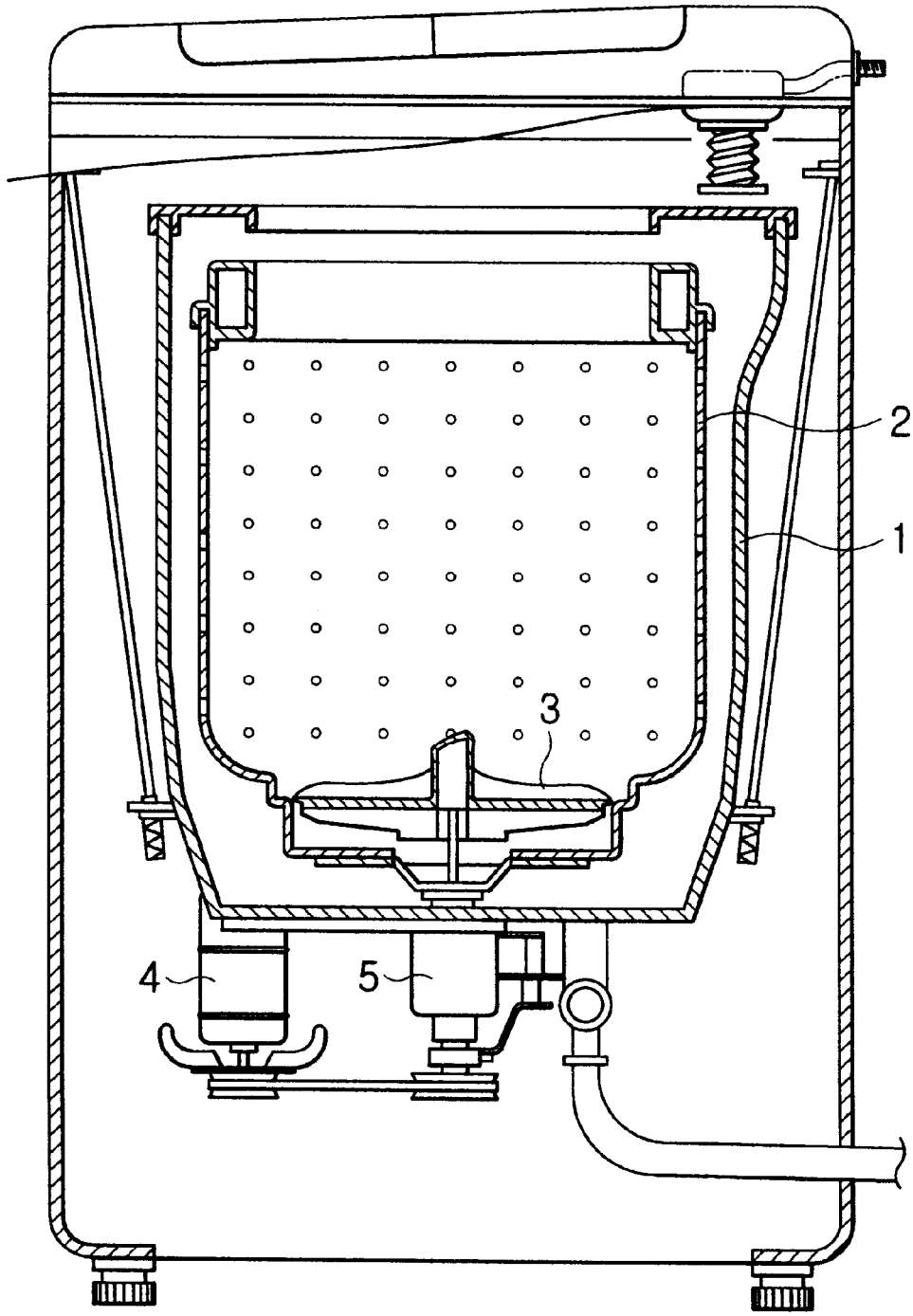
FIG. 1 is a sectional view, showing the construction of a conventional washing machine.

Reference now should be made to the drawings, in which the same reference numerals are used throughout the different drawings to designate the same or similar components.

Figure 2:
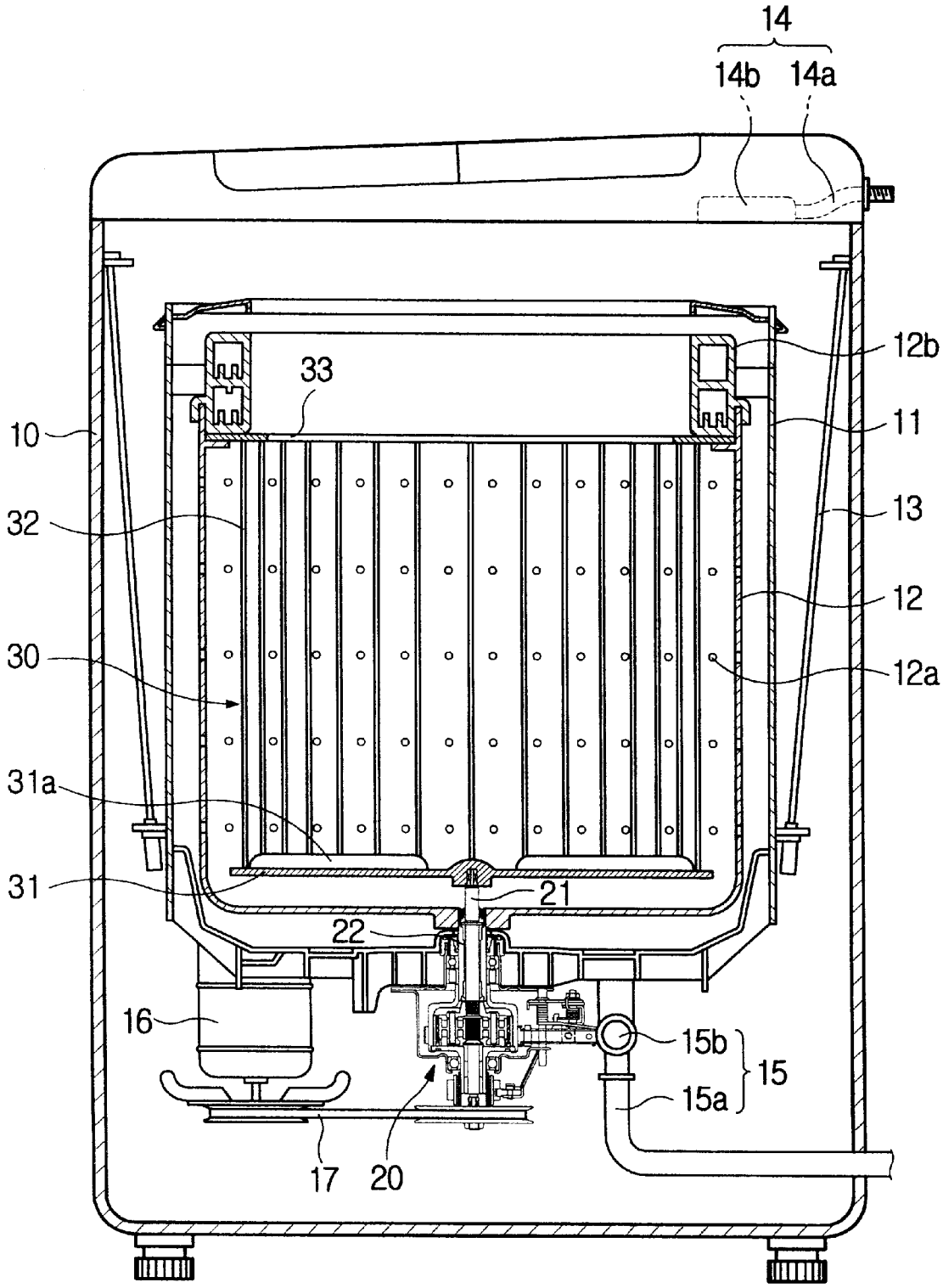
FIG. 2 is a sectional view, showing the construction of a washing machine in accordance with the primary embodiment of the present invention.

FIG. 2 is a sectional view, showing the construction of a washing machine in accordance with the primary embodiment of the present invention.

As shown in FIG. 1, the washing machine according to the present invention includes an outer tub 11, which is housed within a cabinet 10 and contains water therein. A perforated spin-drying tub 12 is concentrically and rotatably set within the outer tub 11. A twistable washing tub 30 is set within the spin-drying tub 12, and is twisted and deformed at its sidewall to compress the laundry during its rotating. The washing machine also has a drive unit for rotating at least one of the spin-drying tub 12 and the washing tub 30. This drive unit is installed on the outer surface of the bottom wall of the outer tub 11.

The outer tub 11 is suspended within the cabinet 10 by means of a plurality of suspension rods 13, each of which is connected to the top portion of the sidewall of the cabinet 10 and the lower portion of the outer tub 11. A water supply unit 14, comprising a water supply pipe 14*a* and a control valve 14*b*, is provided at the top of the outer tub 11 for feeding water into the outer tub 11 as desired. A drain unit 15, comprising a drain pipe 15*a*, a drain control valve 15*b* and a drain motor (not shown), is provided at the bottom wall of the outer tub 11 for draining water from the outer tub 11 as desired.

The spin-drying tub 12 is rotated at a high speed to spin-dry the laundry after a washing process or a rinsing process. This spin-drying tub 12 is a cylindrical tub, which is opened at its top and is perforated at its sidewall to form a plurality of perforations 12*a*. A balancer 12*b* is installed at the top of the spin-drying tub 12 for allowing the tub 12 to be stably rotated at a high speed.

The drive unit includes a reversible drive motor 16 and a power transmission device 20. The motor 16 is installed on the outer surface of the bottom wall of the outer tub 11, and generates rotating force when it is electrically activated. The power transmission device 20 transmits the rotating force of the motor 16 to at least one of the spin-drying tub 12 and the washing tub 30. The power transmission device 20 is connected to the drive pulley of the motor 16 by means of a belt 17.

Figure 6:
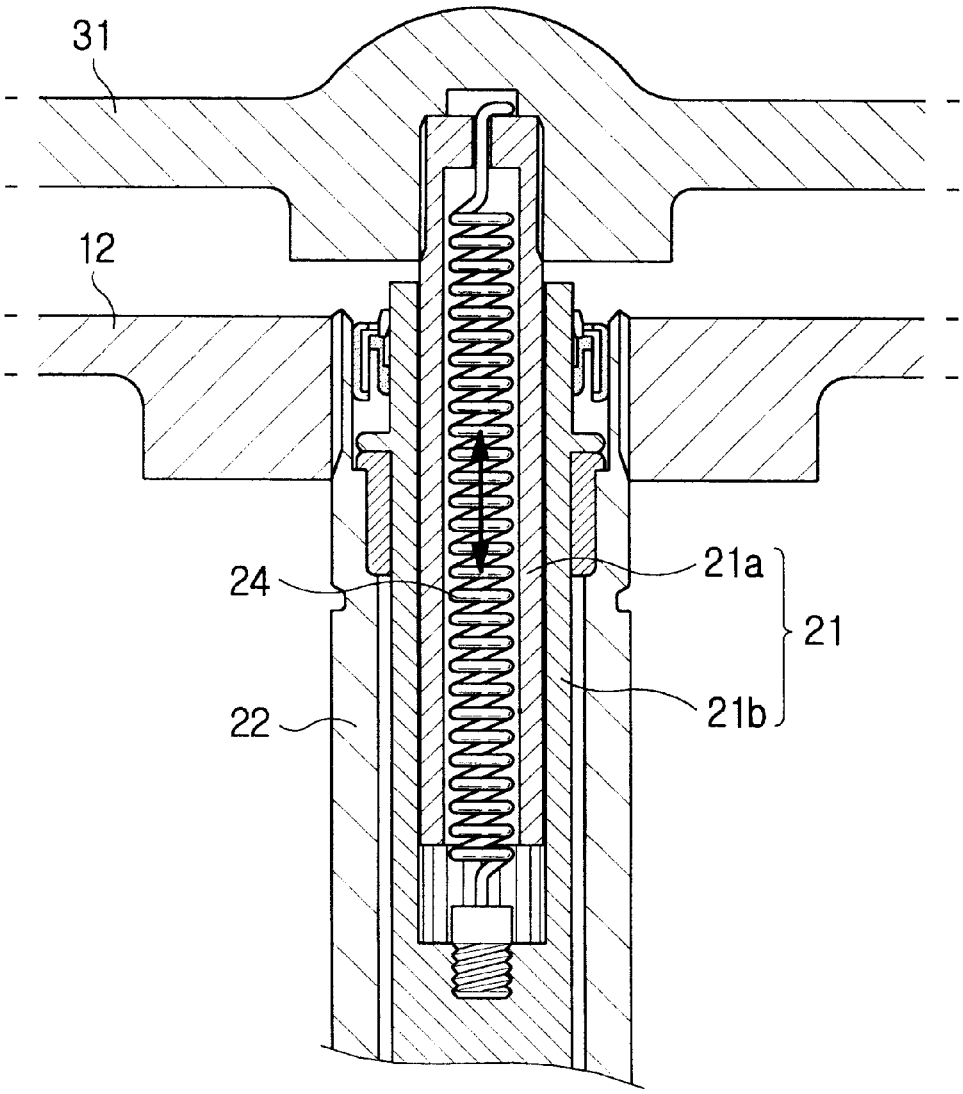
FIG. 6 is a sectional view, showing the construction of a washing tub shaft included in the washing machine, in addition to a locking structure for locking the washing tub shaft to a lower rotary disc in accordance with an embodiment of this invention.

The power transmission device 20 includes a washing tub shaft 21 and a spin-drying tub shaft 22. The washing tub shaft 21 is connected to the bottom of the washing tub 30, while the spin-drying tub shaft 22 is a hollow shaft fitted over the washing tub shaft 21 and connected to the bottom of the spin-drying tub 12 as shown in FIG. 6. The power transmission device 20 also has a clutch unit, a reduction gear unit, and a brake unit even though said units are not shown in detail in the accompanying drawings. The clutch unit controls the transmission of the rotating force of the motor 16 to at least one of the two shafts 21 and 22. The reduction gear unit controls the rotating speed of the washing tub shaft 21. The brake unit selectively brakes the spin-drying tub shaft 22 when it is desired to control the rotating speed of the spin-drying tub 12 or stop the rotating of the tub 12.

Figure 3:
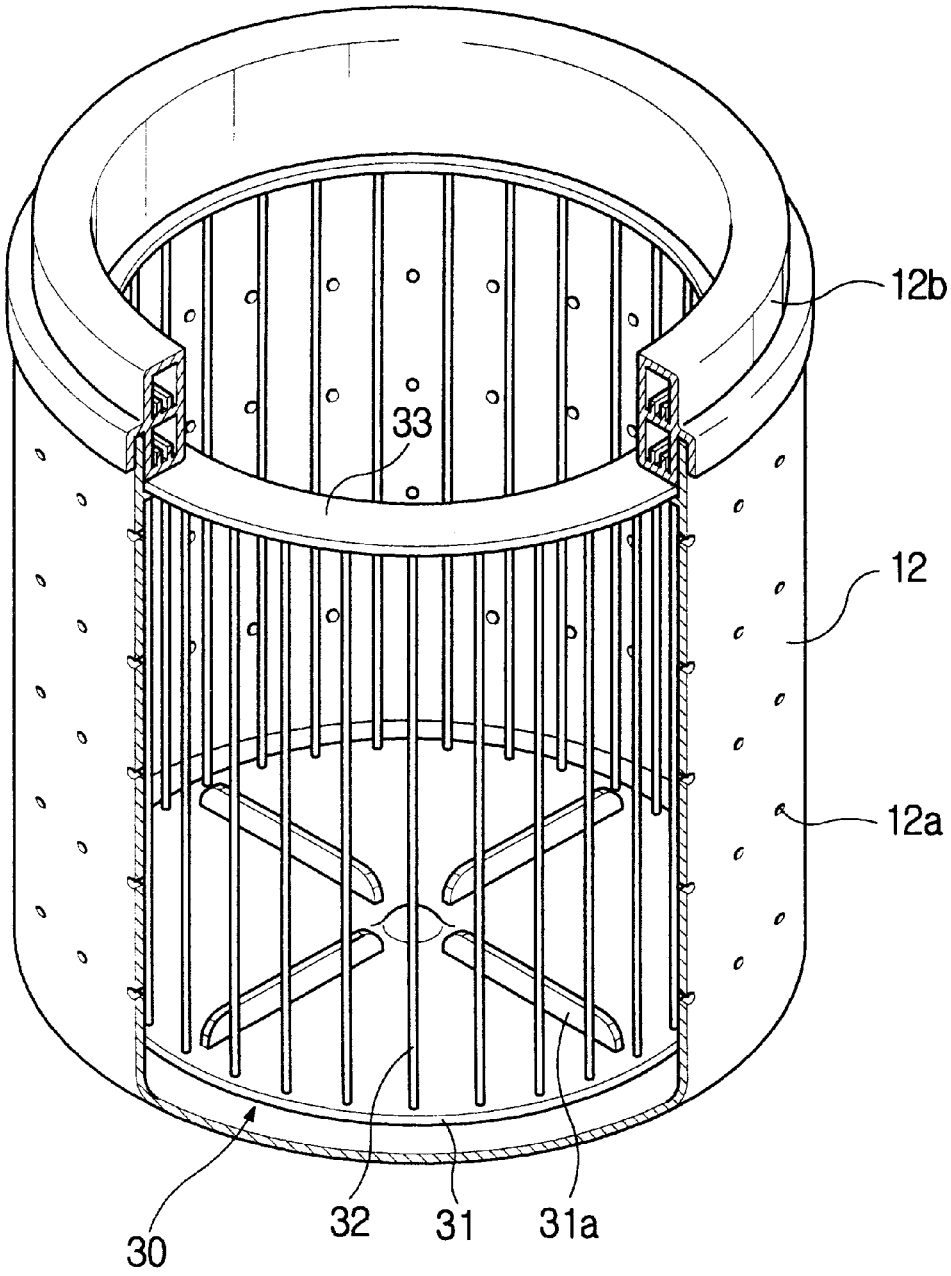
FIG. 3 is a partially broken perspective view, showing the construction of both a perforated spin-drying tub and a twistable washing tub of the washing machine according to the present invention.
Figure 4:
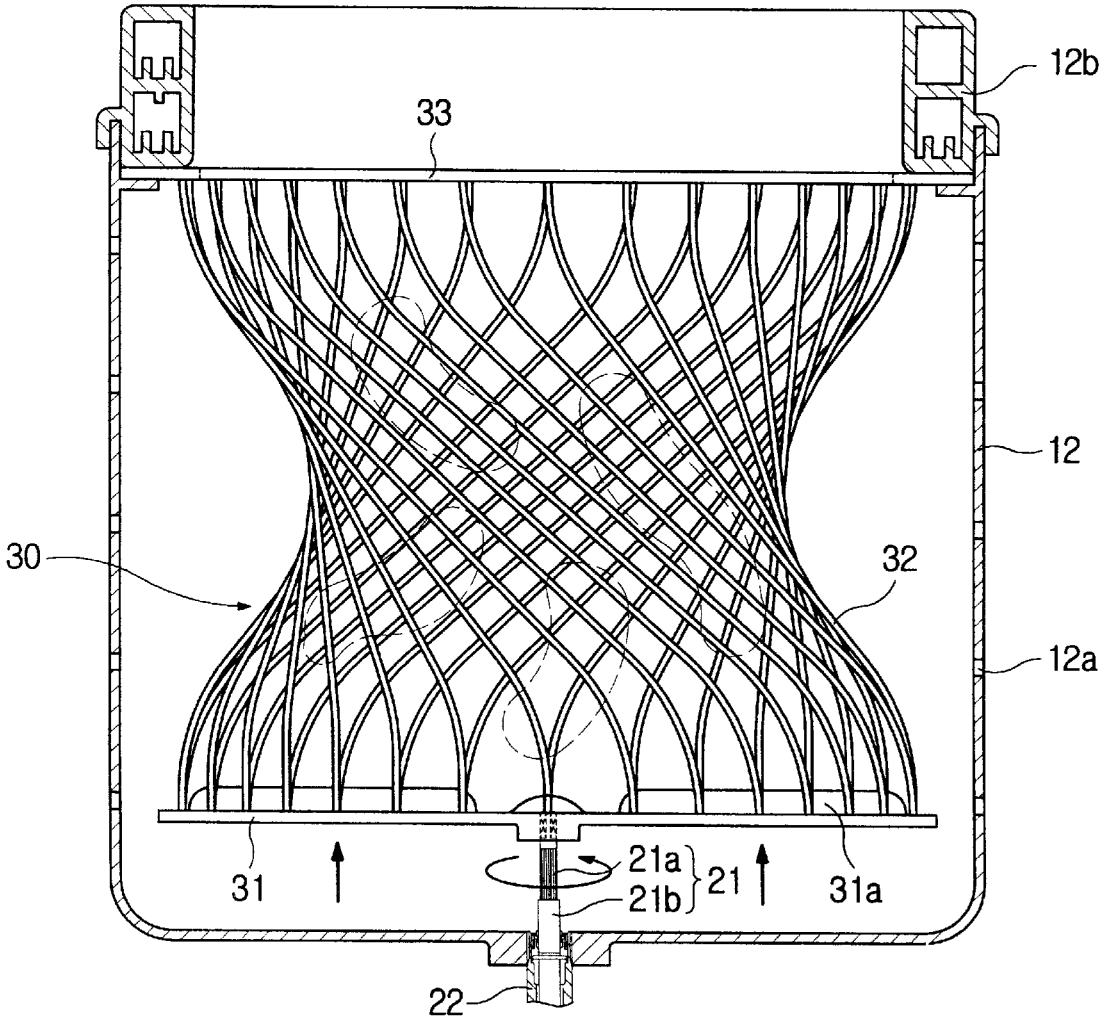
FIG. 4 is a sectional view, showing an operation of both the perforated spin-drying tub and the twistable washing tub of this washing machine.

As shown in FIGS. 3 and 4, the twistable washing tub 30 comprises a lower rotary disc 31, a plurality of twistable bars 32, and an upper ring 33. The lower rotary disc 31*b* is mounted to the washing tub shaft 21 at a position inside the perforated spin-drying tub 12. The twistable bars 32, having the same length, upwardly extend in a vertical direction from the edge of the lower rotary disc 31 at regular positions, and are fixed to the upper ring 33 at their top ends.

The rotary disc 31 is a circular member having a predetermined diameter, with a plurality of pulsating blades 31*a* formed on the top surface of the disc 31 in a radial direction to generate active swirling currents in the washing water during a rotating action of the disc 31.

Each of the twistable bars 32 is mounted to the edge of the rotary disc 31 at its bottom end, and is mounted to the upper ring 33 at its top end. The twistable bars 32 are arranged along the edge of the rotary disc 31 at regular intervals, and form the sidewall of the washing tub 30. The twistable bars 32 are made of a flexible and elastic material capable of allowing the bars 32 to be desirably twisted during a rotating action of the rotary disc 31.

Figure 5A:
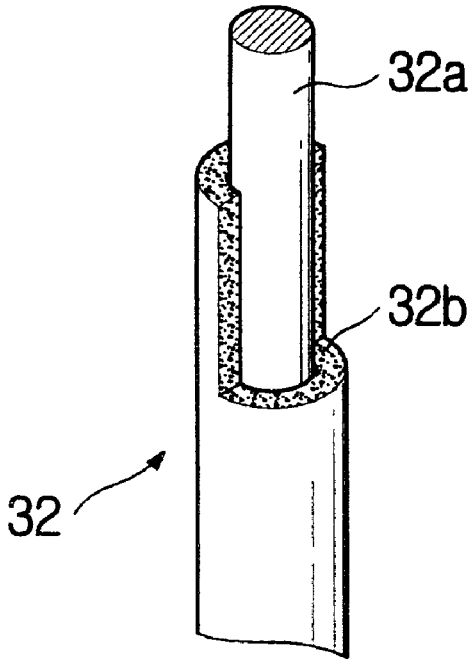
FIGS. 5*a* to 5*c* are views, showing a variety of twistable bars included in the washing tub in accordance with different embodiments of the present invention.
Figure 5B:
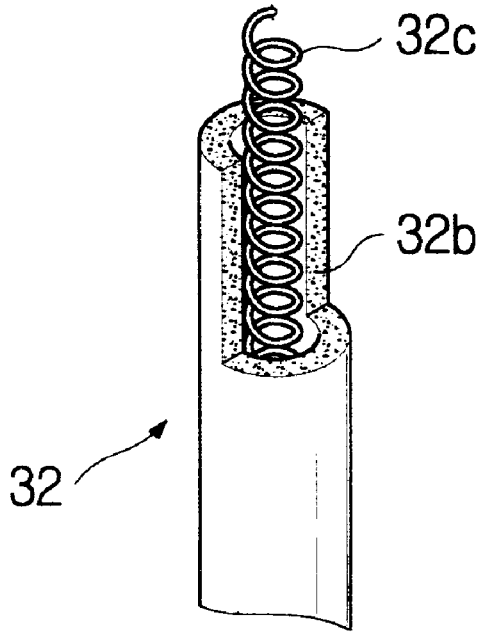
Figure 5C:
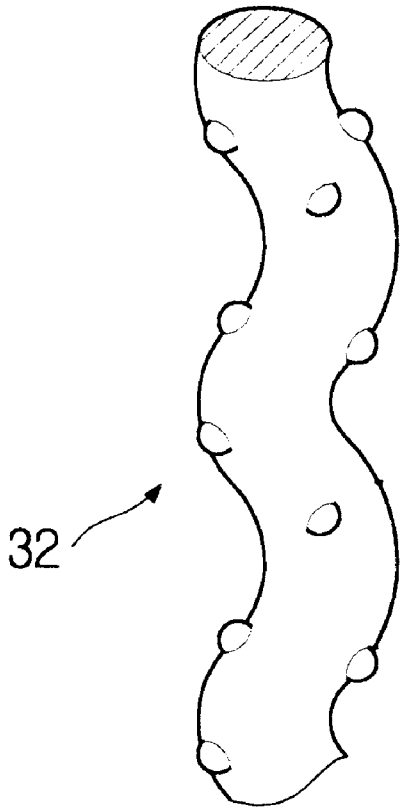

That is, it is preferable to make the twistable bars 32 using steel, plastic, or rubber having predetermined elasticity and stiffness. In an embodiment of the present invention, each of the twistable bars 32 may be fabricated with a steel or plastic core 32*a* and a soft rubber sheath 32*b* as shown in FIG. 5*a*. When it is desired to make a twistable bar 32 having a high elongation, a coil spring 32*c* may be used as the core of the bar 32 as shown in FIG. 5*b*. When the twistable bars 32 are designed such that each bar 32 is repeatedly bent and repeatedly embossed with small projections on its outer surface as shown in FIG. 5*c*, it is possible to accomplish enhanced cleaning effect of the washing tub 30.

The upper ring 33 fixedly holds the top ends of the twisting bars 32, thus reinforcing the upper portion of the washing tub 30, in addition to maintaining the regular intervals between the bars 32. This upper ring 33 is placed at a predetermined position under the balancer 12*b* of the spin-drying tub 12. The upper ring 33 holds the top ends of the twistable bars 32 without allowing any movement of said top ends of the bars 32 during a rotating action of the rotary disc 31, thus allowing the bars 32 to be twisted during such a rotating action of the disc 31. That is, the upper ring 33 is fixed to the spin-drying tub 12 that is maintained at its stop position during a washing process, the twistable bars 32 are twisted in response to a rotating action of the rotary disc 31. The twisted bars 32 of the washing tub 30 in such a case thus compress the laundry to improve the laundry cleaning effect.

As shown in FIG. 6, the washing tub shaft 21 mounted to the rotary disc 31 of the washing tub 30 comprises first and second shaft parts 21*a* and 21*b*, which are coupled together such that the shaft 21 is extendable in an axial direction. The first shaft part 21*a* is mounted to the disc 31*a*t its top end, and is movably fitted into the fixed second shaft part 21*b*. That is, the two shaft parts 21*a* and 21*b* are telescopically coupled to each other such that the first shaft part 21*a* is vertically movable in opposite directions relative to the second shaft part 21*b*. The rotary disc 31 of the washing tub 30 is thus vertically movable in opposite directions along with the first shaft part 21*a* during its rotating action. When the twistable bars 32 are twisted by the rotating action of the rotary disc 31, it is necessary to allow the disc 31 to be vertically movable in opposite directions since the upper ring 33 fixed to the spin-drying tub 12 cannot be movable in the vertical direction. In the present invention, the telescopic coupling of the first and second shaft parts 21*a* and 21*b* may be easily accomplished by a conventional spline shaft coupling or a conventional serrated shaft coupling.

A return spring 24 is connected to the lower surface of the rotary disc 31, and normally biases the rotary disc 31 downward. This return spring 24 thus allows the disc 31 to be easily and smoothly lowered from its lifted position when the rotating direction of the disc 31 is changed. The twisted bars 32 are thus smoothly untwisted without being undesirably entangled together. The opposite directional vertical movement of the rotary disc 31 generates active upward and downward water currents capable of improving the laundry cleaning effect.

Figure 7:
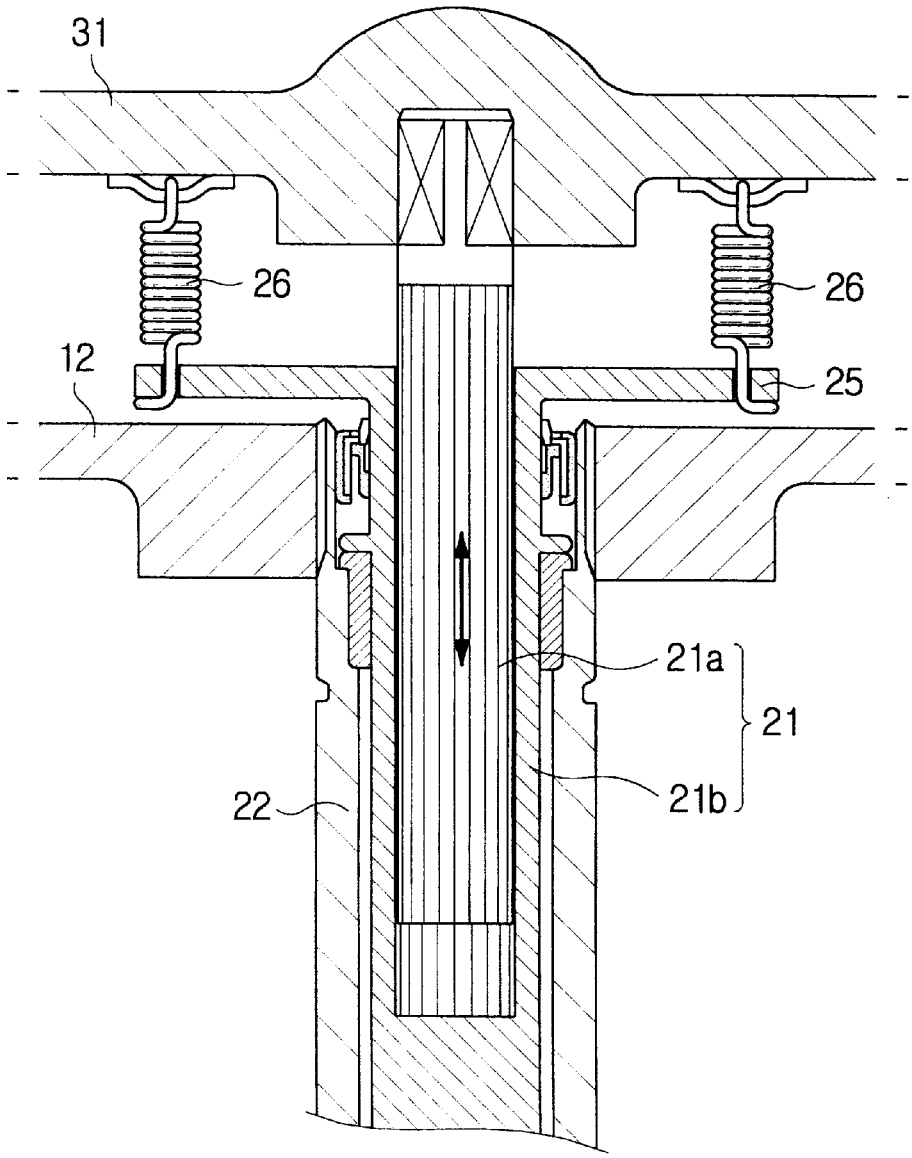
FIG. 7 is a sectional view, showing the construction of a washing tub shaft included in the washing machine, in addition to a locking structure for locking the washing tub shaft to a lower rotary disc in accordance with another embodiment of the present invention.

In order to install the return spring 24, the first and second shaft parts 21*a* and 21*b* of the washing tub shaft 21 may be designed to be hollow and receive the spring 24 therein as shown in FIG. 6. Alternatively, a flange 25 may be formed on the upper portion of the second shaft part 21*b*, with a plurality of return springs 26 each connected to both the flange 25 and the lower surface of the rotary disc 31 as shown in FIG. 7.

Figure 8:
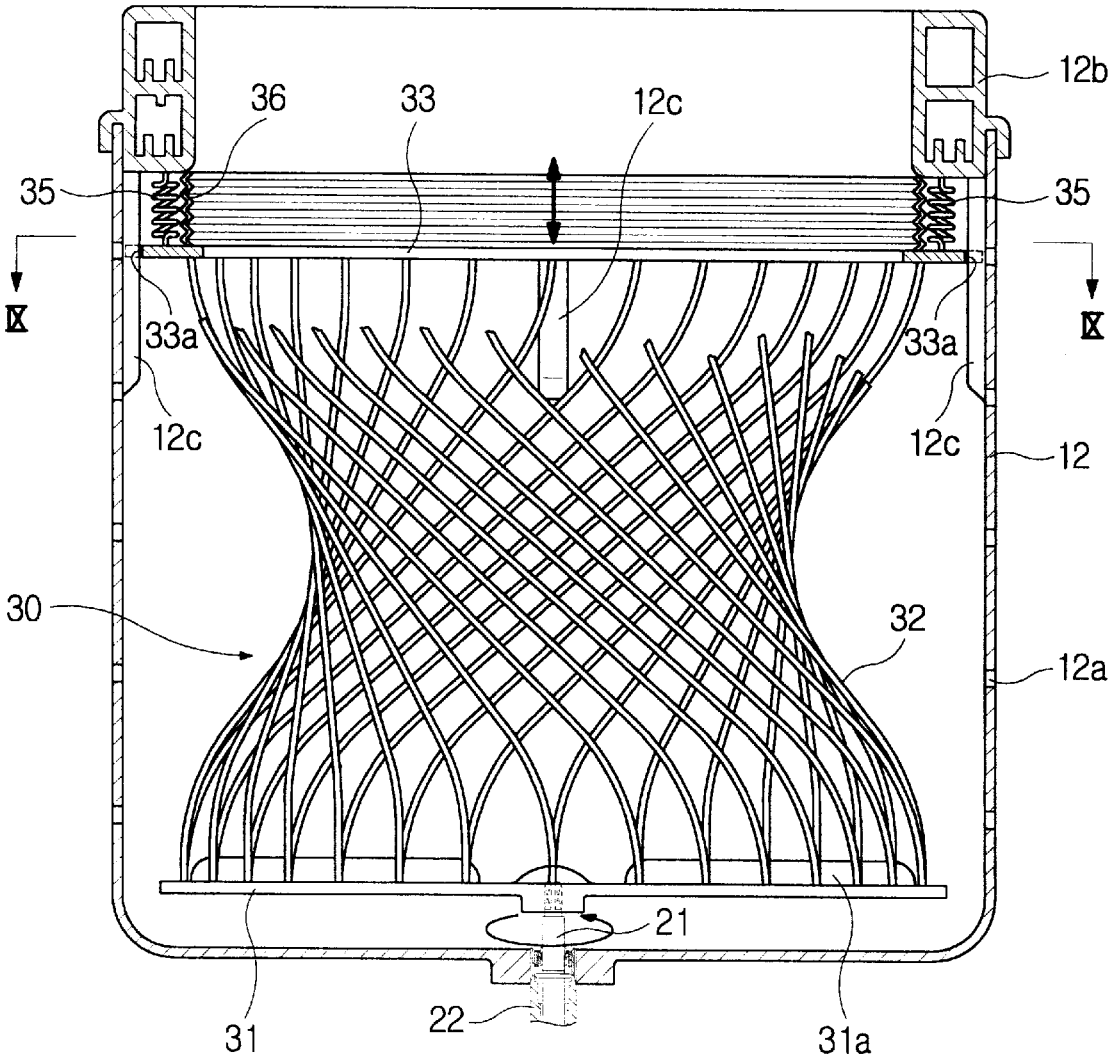
FIG. 8 is a sectional view, showing an operation of both a perforated spin-drying tub and a twistable washing tub included in a washing machine in accordance with a further embodiment of the present invention.
Figure 9:
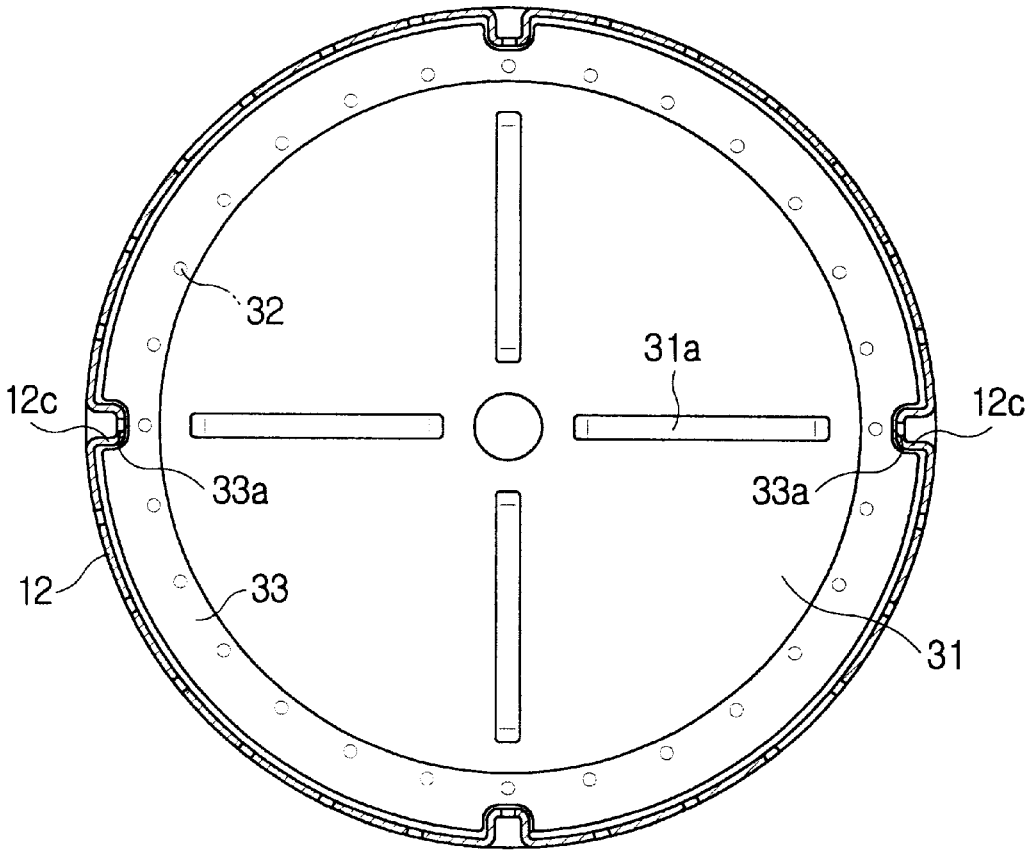
FIG. 9 is a sectional taken along the line IX—IX of FIG. 8.

FIG. 8 shows a washing machine in accordance with a further embodiment of the present invention. In the embodiment of FIG. 8, the washing tub 30 is designed such that the upper ring 33 in place of the lower rotary disc 31 is vertically movable in opposite directions, different from the primary embodiment. That is, when the twistable bars 32 are twisted by a rotating action of the rotary disc 31, the upper ring 33 is vertically moved downward along the inner surface of the spin-drying tub 12. When the twisted bars 32 are untwisted by a change in the rotating direction of the rotary disc 31, the upper ring 33 is vertically moved upward along the inner surface of the spin-drying tub 12. In such a case, it is not necessary for the lower rotary disc 31 to be vertically movable, and so the washing tub shaft 21 is designed as a single structure. In order to accomplish a smooth vertical movement of the upper ring 33 relative to the inner surface of the spin-drying tub 12, a plurality of guide rails 12*c*, each having a predetermined length, are vertically formed on the inner surface of said spin-drying tub 12. A plurality of guide grooves 33*a* are formed on the upper ring 12 at positions corresponding to the guide rails 12*c* of the tub 12 as shown in FIG. 9. The guide rails 12*c* movably engage with the guide grooves 33*a*. A plurality of return springs 35 are each connected to both the upper ring 33 and the balancer 12*b* of the spin-drying tub 12 at its opposite ends, thus normally biasing the ring 33 upward. A cylindrical bellows member 36 covers the gap between the balancer 12*b* of the spin-drying tub 12 and the upper ring 33 of the twistable washing tub 30. This bellows member 36 thus prevents laundry from undesirably leaking from the washing tub 30 through the gap during a laundry washing process, and prevents the laundry from being undesirably caught by the return springs 25 when the laundry is put into or taken out of the washing tub 30.

Due to the above-mentioned structure, the upper ring 33 of the washing tub 30 is vertically moved in opposite directions within a predetermined stroke relative to the spin-drying tub 12 without being rotated during an opposite directional rotating action of the rotary disc 31. The twistable bars 32 of the washing tub 30 are thus smoothly twisted and compress the laundry during a washing process. When the rotating direction of the rotary disc 31 is changed to untwist the twisted bars 32, the return springs 35 bias the upper ring 33 upward, thus allowing the bars 32 to be smoothly untwisted prior to being twisted in a reverse direction.

The operational effect of the washing machine of this invention will be described herein below.

When the washing machine is started in its operation, it automatically and sequentially performs a washing process, a rinsing process, and a spin-drying process under the control of a controller (not shown).

In the case of a washing process, laundry is put into the twistable washing tub 30 and water laden with detergent is supplied to the outer tub 11. Thereafter, the washing tub 30 is rotated in opposite directions by the rotating force of the reversible drive motor 16, thus performing the washing process. In such a case, the clutch unit of the power transmission device 20 does not transmit the rotating force of the motor 16 to the spin-drying tub shaft 22. In addition, the brake unit brakes the spin-drying tube shaft 22, and so the spin-drying tub 12 is not rotated.

In the primary embodiment with the upper ring 33 of the washing tub 30 fixed to the spin-drying tub 12, only the lower rotary disc 31 is rotated in a direction to twist the twistable bars 32 during such a washing process. The diameter of the middle portion of the washing tub 12 is reduced as shown in FIG. 4. The twisted bars 32 thus compress the laundry within the washing tub 30. When the rotating direction of the rotary disc 31 is changed, the twisted bars 32 are primarily untwisted, and are secondarily twisted in a reverse direction to compress the laundry within the washing tub 30. That is, the twistable washing tub 30 repeatedly compresses and releases the laundry contained therein, thus performing a frictional cleaning effect as if the laundry were washed by hand. The cleaning effect of the washing machine is thus remarkably improved.

Since the lower rotary disc 31 of the washing tub 30 is repeatedly moved upward and downward in a vertical direction during such a washing process, active upward and downward water currents are formed in the outer tub 1. In addition, active swirling water currents are also formed in the outer tub 11 by the pulsating blades 31*a* of the rotary disc 31.

In the embodiment of FIG. 8 with the upper ring 33 of the washing tub 30 designed to be movable relative to the spin-drying tub 12, the lower rotary disc 31 is rotated in a direction, while the upper ring 33 is not rotated. Therefore, the diameter of the middle portion of the washing tub 12 is reduced as shown in FIG. 8. The twisted bars 32 thus compress the laundry within the washing tub 30. When the rotating direction of the rotary disc 31 is changed, the twisted bars 32 are primarily untwisted, and are secondarily twisted in a reverse direction to compress the laundry within the washing tub 30. In such a case, the return springs 35 bias the upper ring 33 upward, and so the upper ring 33 smoothly moves upward under the guide of the rails 12*c* of the spin-drying tub 12. The twistable bars 32 of the washing tub 30 are thus smoothly and repeatedly twisted and untwisted during such a washing process.

After the washing process, the washing machine performs a rinsing process. During such a rinsing process, the washing machine repeats the same process as that described for the washing process, but does not use any detergent. This rinsing mode is to remove detergent components from the laundry by repeatedly rinsing the laundry with water while repeatedly feeding and draining water.

After the rinsing process, the water is drained from the outer tub through the drain unit. After the draining of the water, the power transmission unit changes its transmission mode to rotate both the spin-drying tub and the washing tub at a high speed, thus performing a spin-drying process.

As described above, the present invention provides a washing machine, which has a twistable washing tub inside a perforated spin-drying tub. The sidewall of the washing tub is formed by a plurality of twistable bars, which are repeatedly twisted and untwisted during a washing process, thus repeatedly compressing and releasing the laundry, and improving the laundry cleaning effect.

During such a washing process, the lower rotary disc of the washing tub is vertically moved in opposite directions in response to the repeated twisting action of the twistable bars, thus forming active upward and downward water currents capable of further improving the laundry cleaning effect.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A washing machine, comprising:

an outer tub containing water therein;

a drive unit installed at a position outside said outer tub to generate rotating force; and a washing tub rotatably set within said outer tub and connected to said drive unit at its lower portion, said washing tub being twistable and deformable at its sidewall to compress laundry contained therein when the washing tub is rotated by the rotating force of the drive unit.

2. The washing machine according to claim 1, wherein said washing tub comprises:

a lower rotary disc connected to a washing tub shaft rotated in conjunction with said drive unit;

a plurality of twistable bars upwardly extending from an edge of said lower rotary disc, each of said twistable bars being made of flexible and elastic material; and an upper ring holding top ends of said twistable bars.

3. The washing machine according to claim 2, further comprising:

a spin-drying tub installed outside said washing tub to surround the washing tub, said spin-drying tub being rotated by said drive unit to spin-dry the laundry, with the upper ring being mounted to an upper end of said spin-drying tub.

4. The washing machine according to claim 3, wherein said washing tub shaft comprises first and second shaft parts coupled together such that the washing tub shaft is extendable in an axial direction, thus allowing the lower rotary disc to be vertically movable in opposite directions.

5. The washing machine according to claim 4, further comprising an elastic member for normally biasing said lower rotary disc downward in a vertical direction.

6. The washing machine according to claim 5, wherein said first and second shaft parts of the washing tub shaft are hollow shaft parts, and receive said elastic member therein.

7. The washing machine according to claim 5, wherein said second shaft part is a hollow shaft part fitted over said first shaft part, and has a flange at its upper end, with said elastic member being connected to both said flange and said lower rotary disc at its opposite end.

8. The washing machine according to claim 2, further comprising:

a spin-drying tub installed outside said washing tub to surround the washing tub, said spin-drying tub being rotated by said drive unit to spin-dry the laundry; and guide means for guiding a vertical movement of said upper ring relative to said spin-drying tub, said guide means being provided on both an inner surface of said spin-drying tub and said upper ring.

9. The washing machine according to claim 8, wherein said guide means comprises a guide rail vertically formed on said inner surface of said spin-drying tub, and a guide groove formed on said upper ring at a position corresponding to said guide rail, with an elastic member connected to said upper ring and an upper end of said spin-drying tub and normally biasing said upper ring upward in a vertical direction.

10. The washing machine according to claim 9, wherein a cylindrical bellows member covers a gap between said upper end of the spin-drying tub and said upper ring.

11. The washing machine according to claim 2, wherein one or more pulsating blades are formed on a top surface of said lower rotary disc to generate swirling currents in the water during a rotating action of said rotary disc.

* * * * *